US007798790B2

(12) United States Patent
Lutoslawski et al.

(10) Patent No.: US 7,798,790 B2
(45) Date of Patent: Sep. 21, 2010

(54) VANE PUMP USING LINE PRESSURE TO DIRECTLY REGULATE DISPLACEMENT

(75) Inventors: Jarek Lutoslawski, Toronto (CA); Richard D. Muizelaar, Mississauga (CA)

(73) Assignee: Tesma International, Inc., Concord, Ontario (CA)

( * ) Notice: Subject to any disclaimer, the term of this patent is extended or adjusted under 35 U.S.C. 154(b) by 910 days.

(21) Appl. No.: 11/579,130

(22) PCT Filed: Mar. 30, 2005

(86) PCT No.: PCT/CA2005/000464

§ 371 (c)(1),
(2), (4) Date: Jan. 25, 2007

(87) PCT Pub. No.: WO2005/108792

PCT Pub. Date: Nov. 17, 2005

(65) Prior Publication Data

US 2008/0247894 A1 Oct. 9, 2008

Related U.S. Application Data

(60) Provisional application No. 60/569,055, filed on May 7, 2004.

(51) Int. Cl.
*F04C 2/00* (2006.01)
*F04C 14/18* (2006.01)

(52) U.S. Cl. ..... 418/26; 418/27; 418/30; 417/220

(58) Field of Classification Search ..... 418/24–27, 418/30; 417/220
See application file for complete search history.

(56) References Cited

U.S. PATENT DOCUMENTS

| | | | | |
|---|---|---|---|---|
| 4,437,819 | A | 3/1984 | Merz | |
| 4,679,995 | A * | 7/1987 | Bristow | 418/26 |
| 5,090,881 | A | 2/1992 | Suzuki et al. | |
| 5,752,815 | A | 5/1998 | Müller | |
| 2003/0031567 | A1 | 2/2003 | Hunter et al. | |

* cited by examiner

*Primary Examiner*—Theresa Trieu
(74) *Attorney, Agent, or Firm*—Harness, Dickey & Pierce, P.L.C.

(57) ABSTRACT

A variable displacement vane pump includes at least two regulation chambers to provide a regulating force to the cam ring to counter the force applied to the cam ring by a regulating spring and reduce pulsation in the output working fluid from the pump. A first regulation chamber is part of the pump outlet and is in fluid communication with the outlet port of the pump via a passage which allows the pump to be fabricated from a diecast process or the like. A second regulation chamber is connected to the first chamber via an orifice which reduces the pressure of working fluid supplied from the first chamber to the second. The pump outlet need not overlie the pump outlet. Further, a pump with an inlet port with a relatively large initial cross-sectional flow area inhibits cavitation of the working fluid when the pump is operated at higher operating speeds.

28 Claims, 8 Drawing Sheets

VANE PUMP USING LINE PRESSURE TO DIRECTLY REGULATE DISPLACEMENT

RELATED APPLICATIONS

This application claims priority from U.S. Provisional Application 60/569,055 filed May 7, 2004 and the contents of this U.S. provisional patent application are incorporated herein by reference.

FIELD OF THE INVENTION

The present invention relates to variable displacement vane pumps. More specifically, the present invention relates to variable displacement vane pumps in which the cam ring is dampened to deliver output flow with reduced pulsation and/or to variable displacement vane pumps with inlets with increased cross-sectional flow areas.

BACKGROUND OF THE INVENTION

Many industrial and automotive devices require a pressurized supply of incompressible fluid such as lubricating oil to operate. Pumps, typically used to supply these fluids, can either be of constant displacement (i.e.—volumetric displacement) or variable displacement designs.

With a constant displacement pump, the pump outputs a substantially fixed volume of working fluid for each revolution of the pump. To obtain a desired volume and/or pressure of the working fluid the pump must either be operated at a given speed, independent of the speed of the automotive engine or other device supplied by the pump, or a pressure relief valve must be provided to redirect surplus flow, when the pump is operated above the speed required for the desired flow, to the low pressure side of the pump or to a working fluid reservoir.

With a variable displacement pump, the volumetric displacement of the pump can be altered, to vary the volume of fluid output by the pump per revolution of the pump, such that a desired volume of working fluid can be provided substantially independently of the operating speed of the pump.

Variable displacement pumps are typically preferred over constant displacement pumps with relief valves in that the variable displacement pumps offer a significant improvement in energy efficiency, and can respond to changes in operating conditions more quickly than pressure relief valves in constant displacement pumps.

While variable displacement vane pumps are well known, they do suffer from some disadvantages. For example, differences in the fluid pressures of the pump chambers (formed between adjacent vanes, the rotor and the cam ring) can cause undesirable variations, or pulsations, on the cam ring, as the pump chambers move with the rotor, which results in pulsations in the output pressure of the pump.

U.S. Pat. No. 4,679,995 to Bistrow discloses a variable displacement vane pump wherein a dampening force is applied to the cam ring of the pump to reduce the pulsations of the cam ring. In one embodiment, the dampening force is provided by pressurized working fluid in a chamber adjacent the cam ring. The working fluid is provided from the outlet of the pump, through a passage which is obstructed depending upon the position of the cam ring, to alter the pressure and thus the resulting dampening force. In another embodiment, the working fluid is supplied from the outlet to the cam ring through a tapered recess in which a complementary tapered piston is moved by the cam ring.

However, the pump taught in Bistrow also suffers from disadvantages. Specifically, to provide the cored passages required by the Bistrow pump to supply the working fluid to the chamber, the pump must be manufactured by sand casting which increases both the manufacturing cost, production cycle time and precludes the use of desirable materials such as aluminum for forming the body of the pump.

Diecast variable displacement vane pumps with dampening have been produced previously, but such pumps have been limited to having their outlet located underneath and overlying the outlet port of the rotor chamber, to avoid the need for a cored passage and thus permitting the pump to be diecast. However, because the outlet must be located overlying the rotor chamber outlet port, the layout, port locations, size and volume (i.e. the "packaging") of such pumps has been quite limited.

Another problem with existing pumps is that the inlet port in the rear plate of prior art pumps is typically in the form of an arc which has a small cross-sectional flow area where it connects to the inlet of the pump and the cross-sectional flow area increases as the arc extends circumferentially about the rotor. The cross-sectional flow area of the inlet port is relatively small in the area where it connects to the pump inlet to ensure that adequate surface sealing area still exists between the cam ring and the rear plate about the pump inlet and inlet port interface. However, such small cross-sectional flow areas can lead to undesired cavitation in the inlet as the pump is operated at higher speeds.

It is desired to have a variable displacement vane pump capable of being manufactured by diecasting or other techniques which can be flexibly packaged and which has dampening on the cam ring. It is also desired to have a variable displacement vane pump with an inlet that reduces the onset of cavitation.

SUMMARY OF THE INVENTION

It is an object of the present invention to provide a novel dampened variable displacement vane pump which obviates or mitigates at least one disadvantage of the prior art. It is a further object of the present invention to provide a vane pump with an inlet port with an increased initial cross-sectional flow area.

According to a first aspect of the present invention, there is provided a variable displacement vane pump comprising: a rotor including a plurality of vanes slidably extending radially from the rotor; a pump housing defining a pump inlet, a pump outlet and a rotor chamber receiving the rotor and including an inlet port in communication with the pump inlet and through which working fluid is introduced to the rotor and an outlet port through which working fluid exits the rotor to the pump outlet, the outlet port being connected to the pump outlet via a passage; a cam ring encircling the rotor, the ends of the vanes of the rotor engaging the inner surface of the cam ring to form variable volume pump chambers between adjacent vanes, the rotor and the cam ring, the cam ring being pivotable within the rotor chamber about a pivot point to alter the eccentricity of the cam with respect to the rotor to change the displacement of the pump; a regulating spring acting between the pump housing and the cam ring to bias the cam ring to a position of maximum eccentricity between the cam ring and the rotor; a first regulating chamber receiving working fluid from the pump outlet, the working fluid applying a regulating force to the cam ring to counter the bias of the regulating spring; and a second regulating chamber receiving working fluid from the first regulating chamber via an orifice, the working fluid applying a regulating force to the cam ring to counter the bias of the regulating spring and the orifice altering the pressure of the working fluid received in the second regulating chamber with respect to the pressure of the regulating fluid in the first regulating chamber.

In one embodiment, the first and second regulating chambers are separated by the orifice, the orifice being formed between the cam ring and the pump housing. In another embodiment, the first and second regulating chambers are separated by a sealing member and wherein the orifice is in the form of a passage about the sealing member.

Preferably, the pump housing is formed via a diecasting process.

According to another aspect of the present invention, there is provided a variable capacity vane pump, comprising: a rotor including a plurality of vanes extending substantially radially from the rotor; a cam ring encircling the rotor, the vanes of the rotor engaging the inner surface of the cam ring to form pump chambers between the rotor, the cam ring and adjacent vanes, and the volume of the pump chambers changing as the rotor is rotated; a pump housing including: a rotor chamber receiving the rotor and cam ring, the cam ring being pivotable about a pivot point to alter the eccentricity of the cam ring with respect to the rotor to alter the amount by which the volume of the pump chambers changes as the rotor rotates; a pump inlet to supply working fluid to the pump; a pump outlet to supply working fluid from the pump; an inlet port in fluid communication with the pump inlet to supply working fluid to the rotor; an outlet port to receive working fluid from the rotor; a passage connecting the outlet port to the pump outlet to transfer working fluid therebetween; a first regulating chamber in fluid communication with the pump outlet to receive working fluid therefrom, the received working fluid creating a regulating force to urge the cam ring away from the position of maximum eccentricity; a second regulating chamber connected to the first regulating chamber via an orifice, the second regulating chamber receiving working fluid from the first regulating chamber and the orifice altering the pressure of the received working fluid, received working fluid creating a regulating force to urge the cam ring away from the position of maximum eccentricity; and a regulating member acting between the pump housing and the cam ring to urge the cam ring to the position of maximum eccentricity.

Preferably, the pivot point comprises a boss extending from one of the body and the cam ring to engage a complementary groove on the other of the body and cam ring.

According to yet another aspect of the present invention, there is provided a variable capacity vane pump, comprising: a rotor including a plurality of vanes extending substantially radially from the rotor; a cam ring encircling the rotor, the vanes of the rotor engaging the inner surface of the cam ring to form pump chambers between the rotor, the cam ring and adjacent vanes, the volume of the pump chambers changing as the rotor is rotated; a pump housing including: a rotor chamber receiving the rotor and cam ring, the cam ring being pivotable to alter the eccentricity of the cam ring with respect to the rotor to alter the amount by which the volume of the pump chambers changes as the rotor rotates; a pump inlet to supply working fluid to the pump; a pump outlet to supply working fluid from the pump; an inlet port in fluid communication with the pump inlet to supply working fluid to the rotor, the inlet port including a large initial cross-sectional flow area through which working fluid can enter the pump chambers; and an outlet port to receive working fluid from the rotor, wherein the cam ring includes a widened portion adjacent the large initial cross-sectional flow area of the inlet port, the widened portion providing an adequate sealing surface between the pump housing and the cam ring adjacent the large initial cross-sectional flow area.

The present invention provides a variable displacement vane pump with at least two regulation chambers to provide a regulating force to the cam ring, to counter the force applied to the cam ring by a regulating spring, to reduce pulsations in the output working fluid from the pump. A first one of the chambers is part of the outlet of the pump and is in fluid communication with the outlet port of the pump via a passage, preferably in the form of a groove which allows the pump to be fabricated from a diecast process or the like. A second regulation chamber is connected to the first chamber via an orifice which reduces the pressure pulsations of the working fluid supplied from the first chamber to the second. The configuration and design of pumps in accordance with the present invention allows for flexible packaging for the pump, as the outlet need not overlie the pump outlet.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
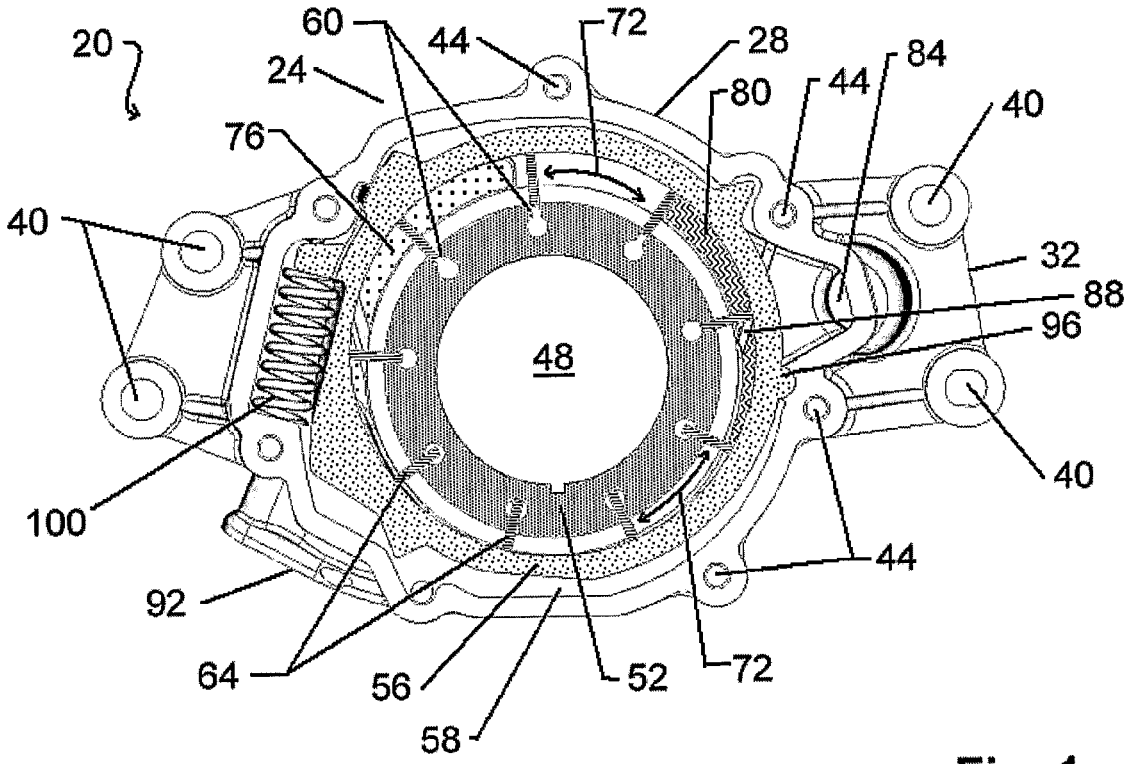
FIG. 1 shows a front view of a variable displacement vane pump in accordance with the present invention with the cover plate of the pump removed.
Figure 2:
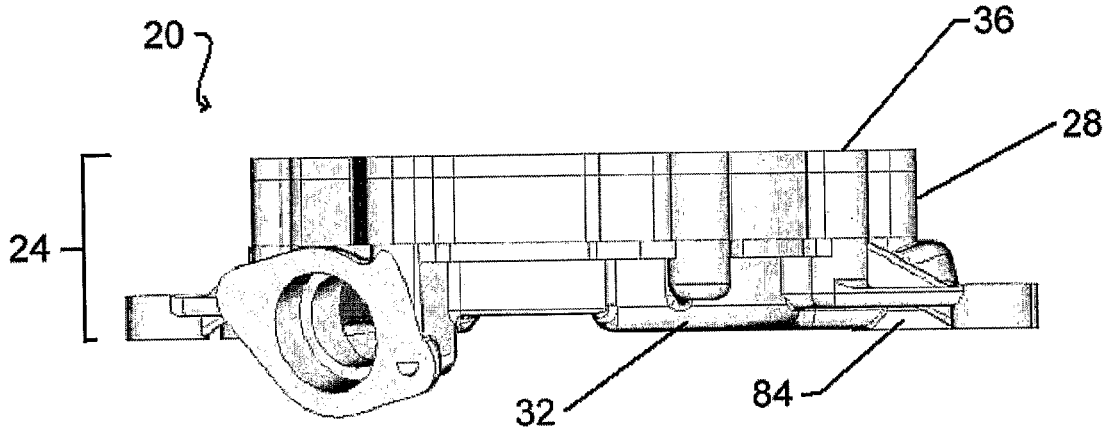
FIG. 2 shows a side view of the pump of FIG. 1.

A variable displacement vane pump in accordance with an embodiment of the present invention is indicated generally at 20 in FIGS. 1 and 2. Pump 20 includes a housing 24 composed of a pump body 28, a rear plate 32 and a cover plate 36 (removed in FIG. 1) placed in spaced-parallel relation to each other. Housing 24 includes one or more holes 40 for mounting onto a mounting plate of an internal combustion engine, or other prime mover, not shown and rear plate 32 includes a set of internally threaded bores which align with through bores 44 in pump body 28 and cover plate 36 to receive bolts to affix cover plate 36, pump body 28 and rear plate 32 to one another. While in the illustrated embodiment pump housing 24 comprises separate components, i.e. pump body 28, rear plate 32 and cover plate 36, it will be apparent to those of skill in the art that pump body 28 can also be integrally formed with either rear plate 32 (in which case housing 24 would comprise a cover plate 36 and an integral housing/rear plate) or with cover plate 36 (in which case housing 24 would comprise rear plate 32 and an integral housing/cover plate).

Pump housing 24 receives a drive shaft 48 which engages a rotor 52 and a control or cam ring 56 in the rotor chamber 58 formed by body 28 and rear plate 32. Drive shaft 48 extends through rear plate 32 to engage a drive means on the internal combustion engine or other prime mover. Rotor 52 is fixed onto drive shaft 48 for rotation therewith in cam ring 56.

Rotor 52 comprises a series of radial, angularly spaced notches 60 in which vanes 64 are slidably mounted. Vanes 64 form, in conjunction with the outer peripheral surface of rotor 52 and the inner peripheral surface cam ring 56, pump chambers 72.

Upon rotation of rotor 52, vanes 64 move into contact with the inner surface of the cam ring 56, under centrifugal force, forming pump chambers 72. Due to the eccentricity of the center of rotor 52 with respect to the center of cam ring 56, as rotor 52 turns, the volume of pump chambers 72 change, with the volume of pump chambers 72 increasing as they enter fluid communication with the inlet port 76, thus drawing working fluid from inlet port 76 into the pump chambers 72. The working fluid drawn from inlet port 76 is transferred, as chambers 72 rotate with rotor 52, to outlet port 80, where the volume of pump chambers 72 is decreased, thus forcing the working fluid into the outlet port 80. Inlet port 76 and outlet port 80 are better seen in FIG. 3.

In pump 20, the pump outlet 84 is spaced from outlet port 80. Accordingly, outlet port 80 is connected to pump outlet 84 by an outlet passage 88, in the form of a groove-like feature formed in rear plate 32 to place pump outlet 84 and outlet port 80 in fluid communication. As outlet passage 88 is in the form of a groove-like feature in rear plate 32, the need for a core is avoided and rear plate 32 including passage 88 can be easily formed via a diecasting process. The pump inlet 92 of pump 20 is in direct fluid communication with inlet port 76, in the conventional manner.

As is well known, by moving cam ring 56 about a pivot the degree of eccentricity between cam ring 56 and rotor 52 can be changed, thus changing the amount by which the volume of pump chambers 72 is altered during rotation of rotor 52, altering the volumetric displacement of pump 20.

In prior art variable displacement vane pumps, a pivot pin is inserted into a bore, defined by cylindrical grooves in the rear plate, pump body, cam ring and cover plate, in the pump housing where these grooves engage the pivot pin enabling the cam ring to thus pivot about the pin. However, forming the above-mentioned grooves for the bore requires multiple machining and assembly steps which increase the cost of manufacturing the pump. In contrast, in the present invention cam ring 56 includes a boss which acts as a pivot point 96 and which engages a complementary groove in body 28. It is also contemplated that pivot point 96 can alternatively be formed as an outwardly extending boss on body 28 and can engage a complementary groove in cam ring 56. In either embodiment, the formation of pivot point 96 and the complementary groove and the assembly of a pump employing such a pivot is simple and cost effective.

As rotor 52 rotates and moves pump chambers 72 out of fluid communication with inlet port 76 the working fluid is pressurized due to changes in the volume of pump chambers 72 (i.e.—the working fluid is pre-compressed during rotation of rotor 52). When the pressurized fluid comes into fluid communication with passage 88 and outlet chamber 104, the pressure of the fluid in the pump chambers 72 is higher than the working fluid in outlet chamber 104 (best seen in FIG. 3) and the transfer of the higher pressure working fluid in the pump chambers 72 to passage 88 and outlet chamber 104 results in a pressure pulsation in the working fluid outlet chamber 104. These pressure pulsations result in undesired movement of cam ring 56, as described below.

In typical usage, variable displacement vane pumps are arranged to have a selected equilibrium operating volume flow, or pressure. This equilibrium operating volume/pressure is usually achieved via a regulating member, such as a spring, which acts to bias the cam ring about the pivot point to a position of maximum eccentricity (i.e.—maximum volumetric displacement). Against the biasing force produced by the spring is a force produced by the working fluid produced by the pump. In prior art variable displacement pumps, a portion of the rotor chamber outside the cam ring is used as a regulation chamber which is in fluid communication with the output of the pump. The pressure of the working fluid in the regulation chamber creates a force on the cam ring to oppose the biasing force of the spring and, by selecting the spring and the geometry of the chamber, an equilibrium operating volume/pressure can be selected for the pump.

However, the above-described undesired pulsations in the output pressure of variable displacement vane pumps also affect the pressure of the working fluid in the regulation chamber, resulting in corresponding pulsations in the force exerted by the working fluid in the regulation chamber onto the cam ring. When operating at certain conditions and/or speeds, these regulation chamber pulsations on the cam ring reinforce those resulting from the pressure changes in the pump chambers as the pump rotor turns and the cam ring can resonate, resulting in increased unacceptable pulsations in the output pressure of the pump.

Figure 3:
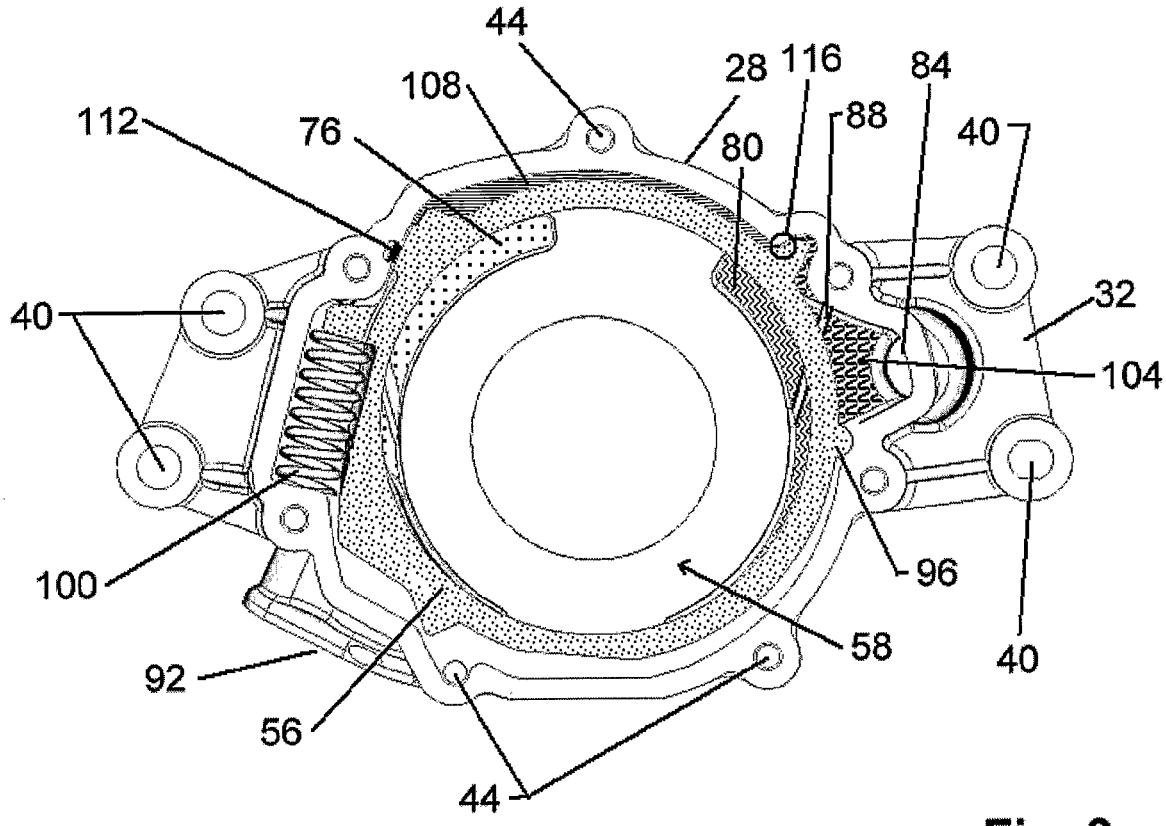
FIG. 3 shows a front view of the pump of FIG. 1 with the rotor and drive shaft removed.

In the present invention, pump 20 includes a regulating member, in the illustrated embodiment a spring 100, to bias cam ring 56 about pivot point 96 to the position of maximum eccentricity between cam ring 56 and rotor 52, similar to prior art pumps. However, as best seen in FIG. 3, the present invention includes a pair of regulation chambers, outlet chamber 104 and regulation chamber 108 in which pressurized working fluid will exert a force on cam ring 56.

Specifically, outlet chamber 104 is part of pump outlet 84 and is supplied with working fluid from outlet passage 88 at the same pressure as the working fluid output at pump outlet 84.

Regulation chamber 108 is formed between body 28, cam ring 56, a seal 112, which can be of any acceptable seal material as will be apparent to those of skill in the art, and an orifice 116.

Figure 4:
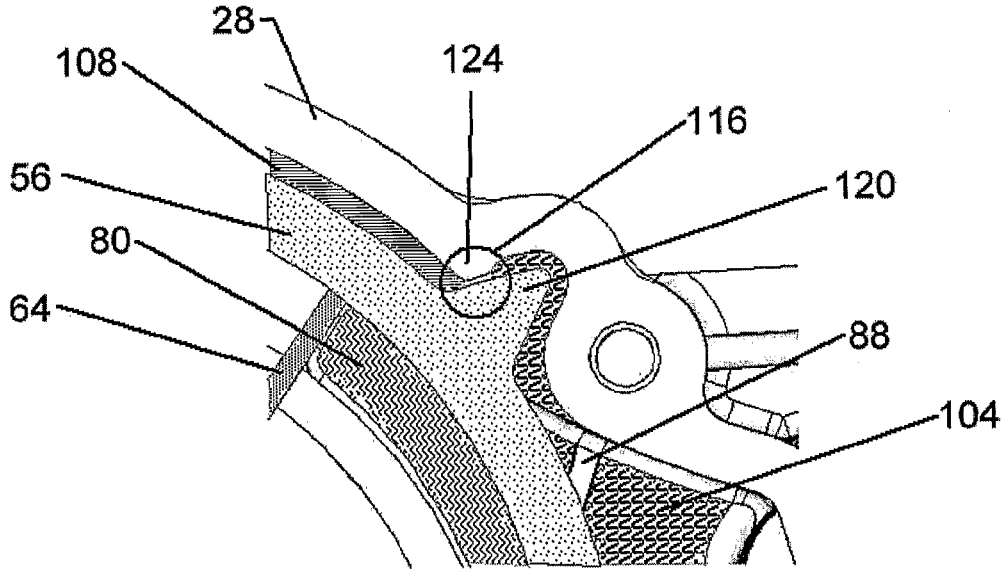
FIG. 4 shows a portion of the pump of FIG. 1 wherein projections on the pump body and cam ring form an orifice therebetween.

Orifice 116, best seen in FIG. 4, is formed between a projection 120 on cam ring 56 and a projection 124 on body 28. As should now be apparent, working fluid at pump outlet 84, and hence in outlet chamber 104, passes through orifice 116 (between projections 120 and 124) and into regulation chamber 108 where orifice 116 creates a pressure drop in the working fluid which passes through it. This pressure drop attenuates the above-mentioned pressure pulsations in the working fluid in regulation chamber 108, preventing the cam ring 56 from resonating at one of its natural frequencies.

Specifically, if the pressure pulsations were not attenuated, they can result in cam ring 56 pulsating as the force exerted on cam ring 56 would increase and decrease with the pulsations and this would result in changes to the displacement of pump 20, resulting in even greater pressure pulsations in the working fluid output from pump 20. In some cases, the pump will be operating at speeds where the pressure pulsations would result in cam ring 56 resonating at one of its natural frequencies which is very undesirable. By attenuating the pressure pulsations in the working fluid in regulation chamber 108, the magnitude of the undesired pulsations in the working fluid are also reduced, reducing the magnitude of the pulsations in the working fluid at pump outlet 84 and the pulsations of cam ring 56, thus inhibiting cam ring 56 from resonating.

As will be apparent to those of skill in the art, as outlet chamber 104 is immediately adjacent pivot point 96, the force on cam ring 56 created by the working fluid in outlet chamber 104 acts through only a very short moment arm while the force created by the working fluid in regulation chamber 108 has a relatively large moment arm about pivot point 96 and thus this force from regulation chamber 108 is the dominate force of the two. As the magnitude of the pulsations in the working fluid in chamber 108 have been reduced, the overall force on cam ring 56 resulting from the pulsations in the working fluid in the regulation chambers comprising outlet chamber 104 and regulation chamber 108 is reduced.

By selecting the configuration and geometry of projections 120 and 124, the pressure drop through orifice 116 can be selected as desired. For example, in the embodiment illustrated in FIGS. 1 through 4, the geometry and shape of projections 120 and 124 have been selected such that the cross-sectional flow area of orifice 116 is substantially constant, independent of the position of cam ring 56 within rotor chamber 58.

Figure 5A:
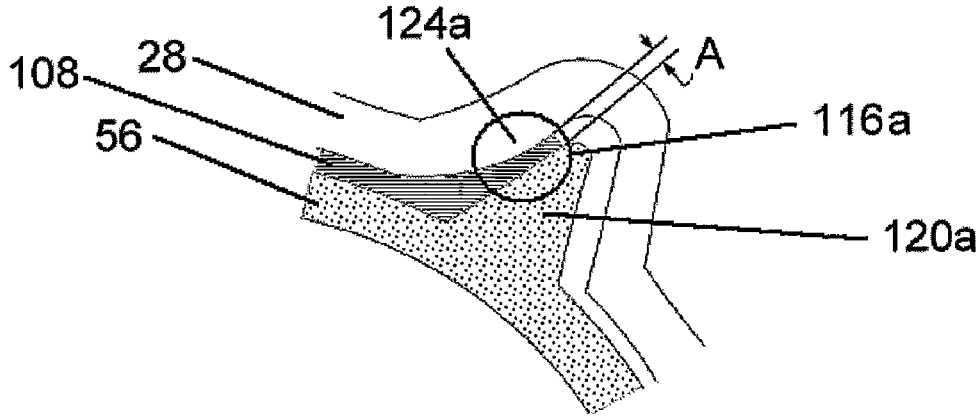
FIGS. 5*a* and 5*b* show another embodiment of an orifice for the pump of FIG. 1.
Figure 5B:
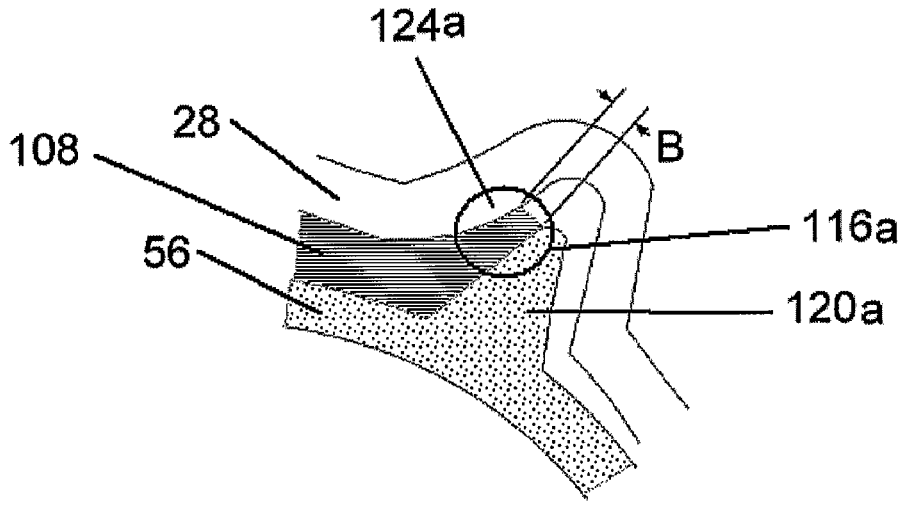

In contrast, in the embodiment shown in FIGS. 5*a* and 5*b*, orifice 116*a* is formed between projections 120*a* and 124*a* whose geometry and shape has been selected such that the cross-sectional flow area of orifice 116*a* changes as cam ring 56 moves about pivot point 96. Specifically, FIG. 5*a* shows cam ring 56 in the position of maximum eccentricity, with respect to rotor 52, and in this position the clearance between projections 120*a* and 124*a* is given by measurement A.

In FIG. 5*b*, cam ring 56 has moved to a position of reduced eccentricity and in this position the clearance between projections 120*a* and 124*a* is given by measurement B. As will be apparent, B is greater than A and thus the cross-sectional flow area (with respect to the flow of working fluid therethrough) of orifice 116*a* increases as cam ring 56 moves from the position of maximum eccentricity. As is well known in fluid dynamics, by increasing the cross-sectional area of orifice 116*a*, working fluid moving through orifice 116*a* will decelerate and the pressure drop across orifice 116*a* will decrease (i.e. the difference in the pressures on each side of orifice 166*a* will be reduced).

Figure 6A:
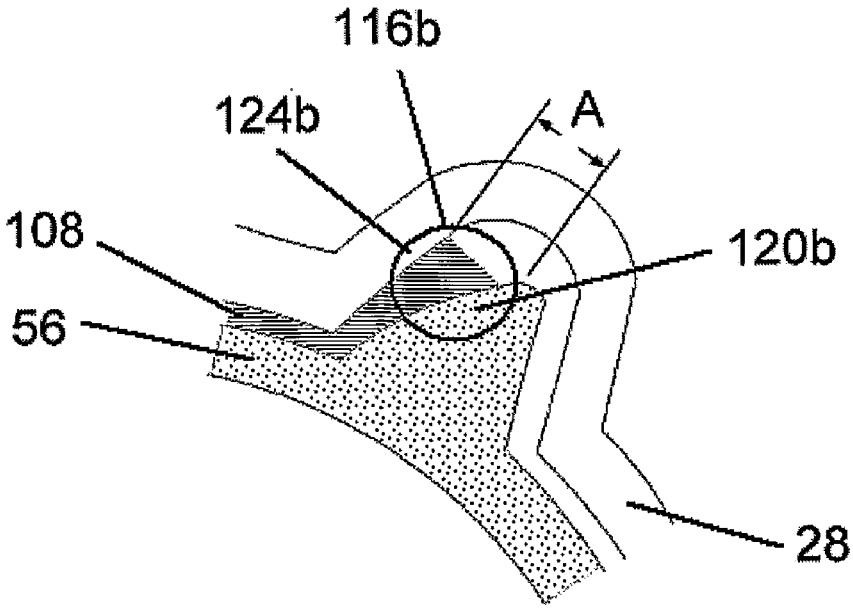
FIGS. 6*a* and 6*b* show another embodiment of an orifice for the pump of FIG. 1.
Figure 6B:
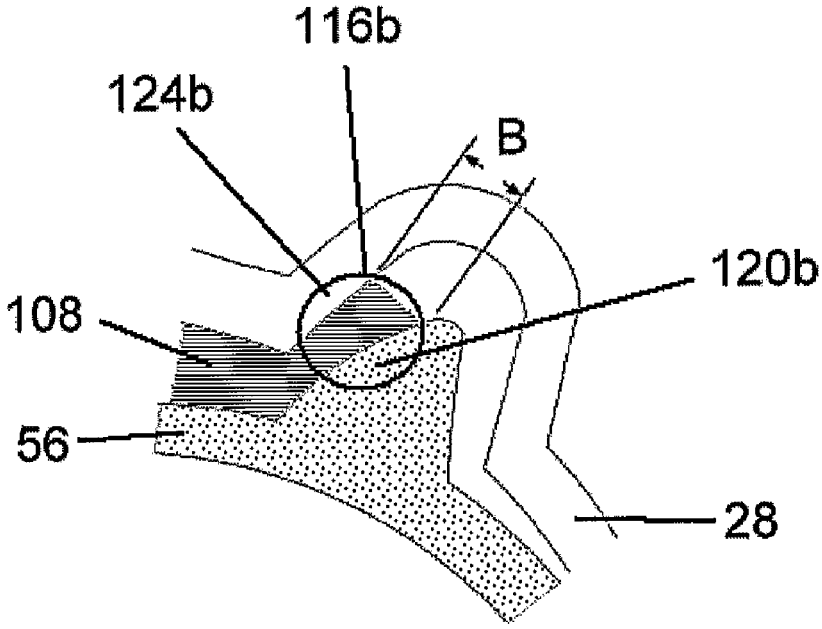

In the embodiment shown in FIGS. 6*a* and 6*b*, orifice 116*b* is formed between projections 120*b* and 124*b* whose geometry and shape has also been selected such that the cross-sectional flow area of orifice 116*b* also changes as cam ring 56 moves about pivot point 96. Specifically, FIG. 6*a* shows cam ring 56 in the position of maximum eccentricity, with respect to rotor 52, and in this position the clearance between projections 120*b* and 124*b* is given by measurement A.

In FIG. 6*b*, cam ring 56 has moved to a position of reduced eccentricity and in this position the clearance between projections 120*b* and 124*b* is given by measurement B. As will be apparent, in orifice 116*b* B is less than A and thus the cross-sectional flow area (with respect to the flow of working fluid therethrough) of orifice 116*b* decreases as cam ring 56 moves from the position of maximum eccentricity. As is well known in fluid dynamics, by decreasing the cross-sectional flow area of orifice 116*b*, working fluid moving through orifice 116*b* will accelerate and the pressure drop across orifice 116*b* will increase (i.e. the difference in the pressures on each side of orifice 166*a* will be increased).

As will be apparent to those of skill in the art, orifice 116 can be designed to yield a variety of different relationships between the position of cam ring 56 and the cross-sectional flow area through orifice 116. In this manner, a designer of pump 20 can obtain a variety of different desired performances for pump 20.

Figure 7:
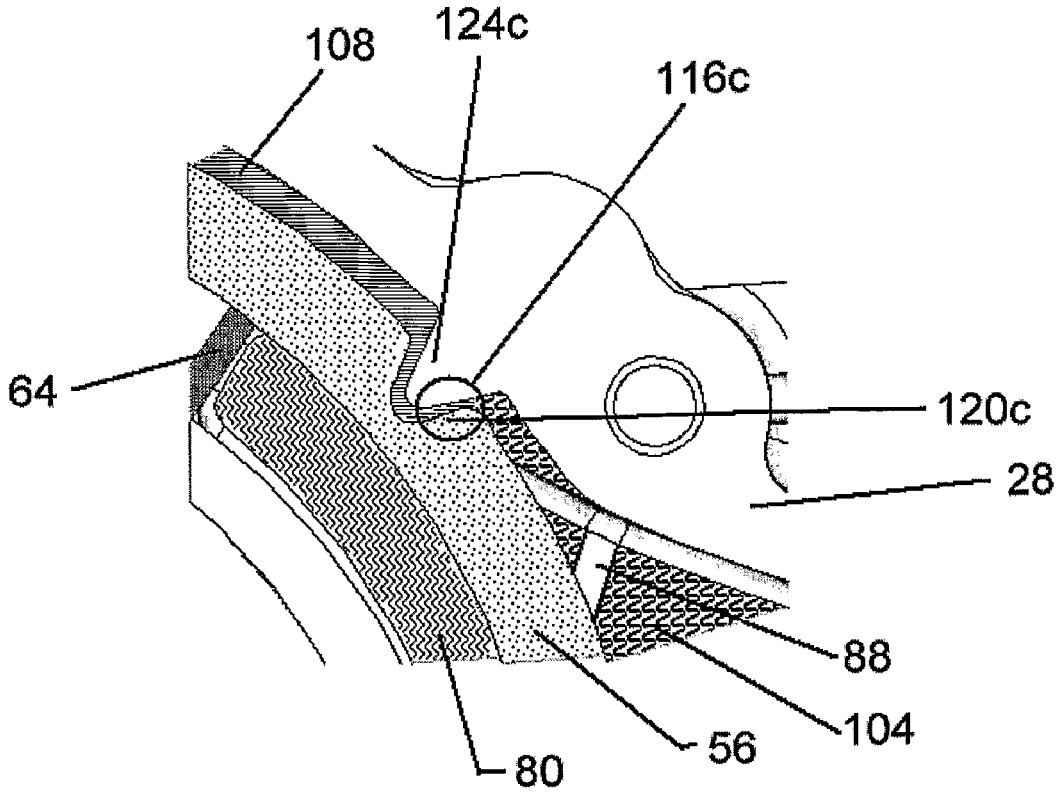
FIG. 7 shows another embodiment of an orifice for use with the pump of FIG. 1.

Another embodiment of an orifice 116*c*, for use with pump 20, is illustrated is FIG. 7. As shown, in this embodiment projection 120*c* is part of a recess in cam ring 56 and projection 124*c* extends from pump body 28 into this recess.

Figure 8:
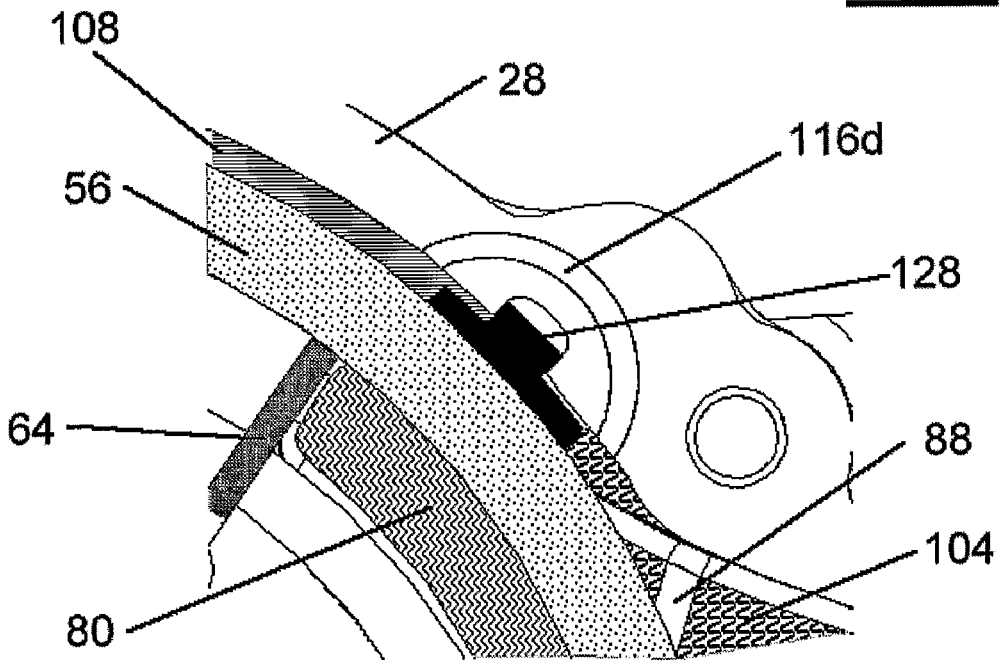
FIG. 8 shows another embodiment of an orifice for use with the pump of FIG. 1.

Yet another embodiment of an orifice 116*d*, for use with pump 20, is illustrated in FIG. 8. As shown, in this embodiment a resilient seal 128, or other suitable member, is employed to separate the regulation chambers comprising outlet chamber 104 and regulation chamber 108 and orifice 116*d* comprises a passage formed in body 28 to connect regulation chamber 108 to outlet chamber 104. As will be apparent, in this configuration orifice 116*d* has a fixed cross-sectional flow area which does not change as cam ring 56 pivots about pivot point 96.

While the embodiments of the pumps described above include two regulation chambers connected by an orifice which alters the pressure of the working fluid supplied to one chamber from the other, the present invention is not so limited and pumps in accordance with the present invention can include three or more regulation chambers, if desired.

Figure 9:
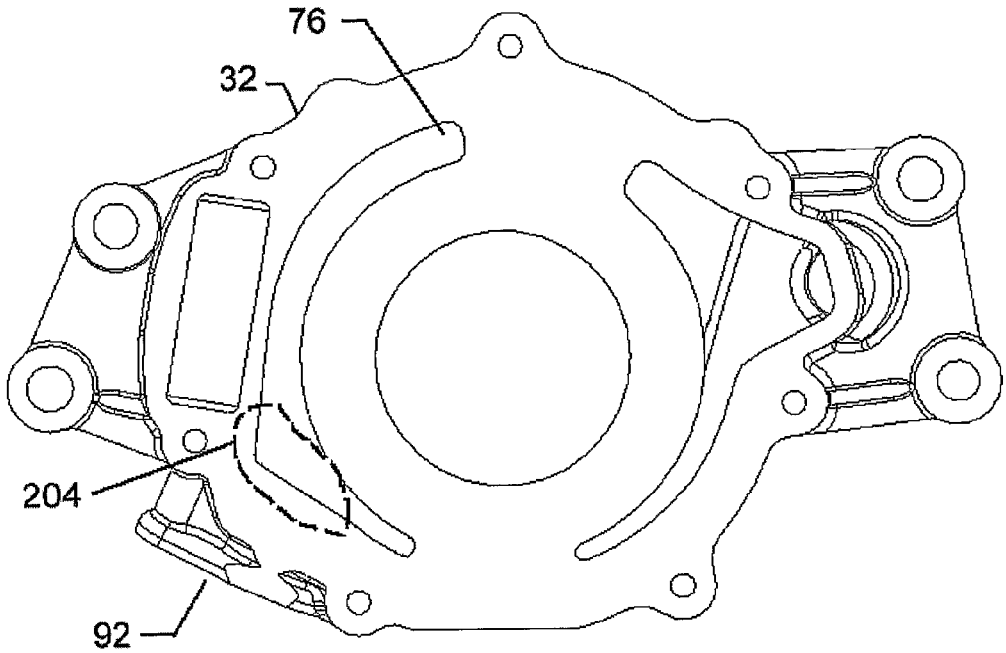
FIG. 9 shows the rear plate of the pump of FIG. 1 with a preferred inlet design.
Figure 10:
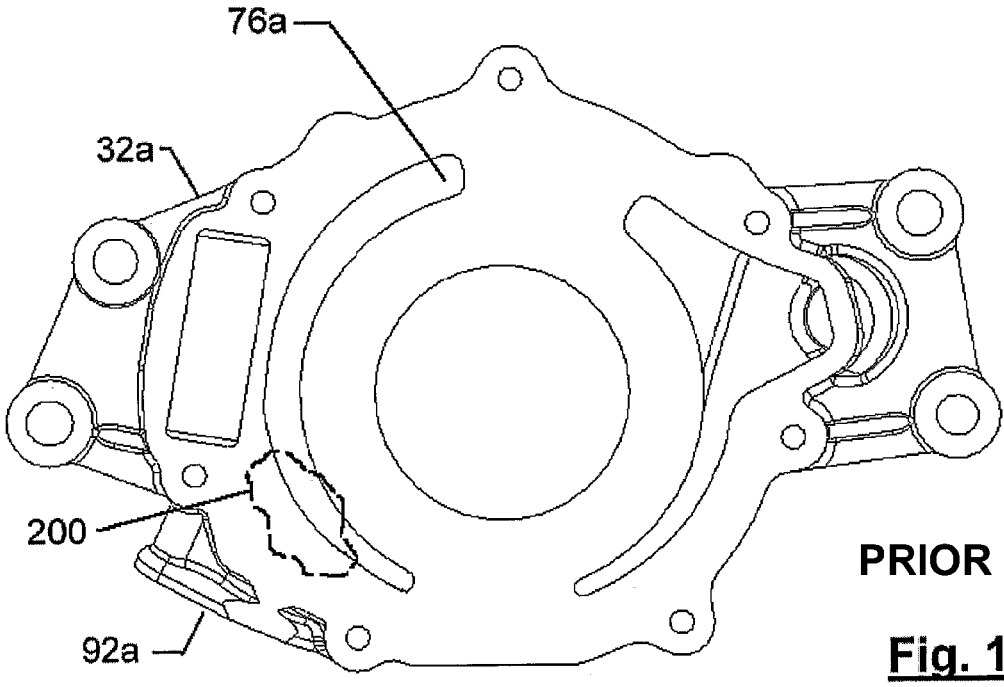
PRIOR ART Fig. 10
FIG. 10 shows the rear plate of FIG. 9 with a conventional inlet design.

FIG. 9 shows rear plate 32 with the other components of pump 20 removed for clarity to illustrate another inventive aspect of pump 20. Specifically, rear plate 32 includes an inlet port 76 which has a greater initial cross-sectional flow area than would be the case with conventional inlet port designs, such as shown in FIG. 10. As shown in FIG. 10, a conventional inlet port 76*a* in a rear plate 32*a* has a quite narrow cross-sectional flow area 200 (indicated by dashed line) adjacent pump inlet 92*a* which can lead to cavitation of the working fluid in inlet port 76*a* when pump 20 operates under relatively high speed conditions.

In contrast, as shown in FIG. 9, inlet port 76 of rear plate 32 has a significantly larger initial cross-sectional flow area 204 (indicated by dashed line) through which working fluid can be introduced to pump chambers 72 from pump inlet 92 to help avoid cavitation of the working fluid in inlet port 76.

Figure 11:
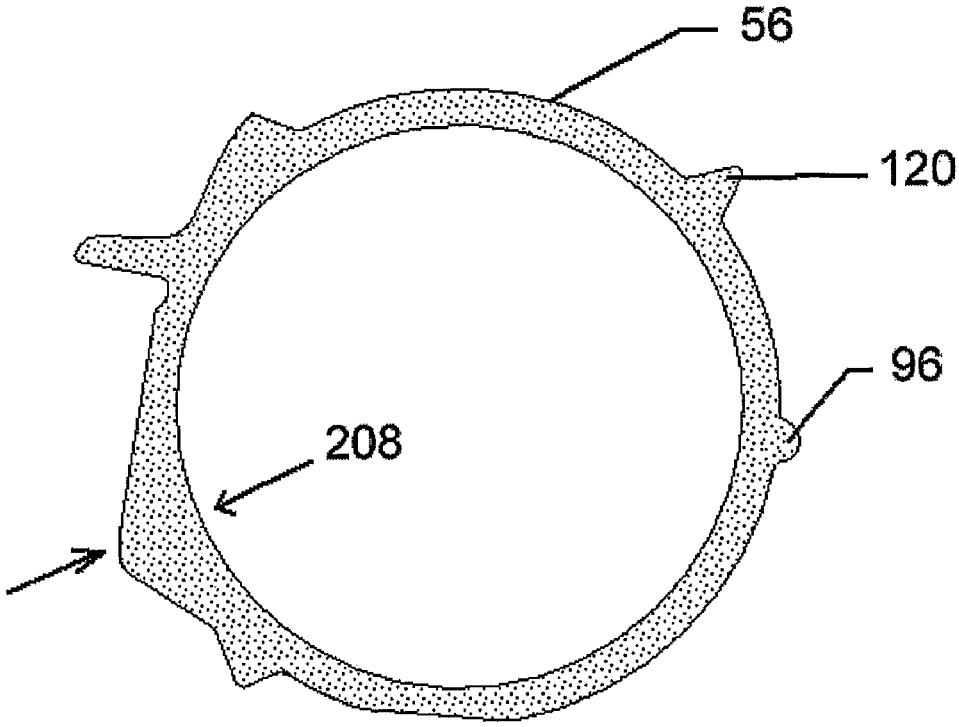
FIG. 11 shows a cam ring for the pump of FIG. 1 for use with the preferred inlet design of FIG. 9.
Figure 12:
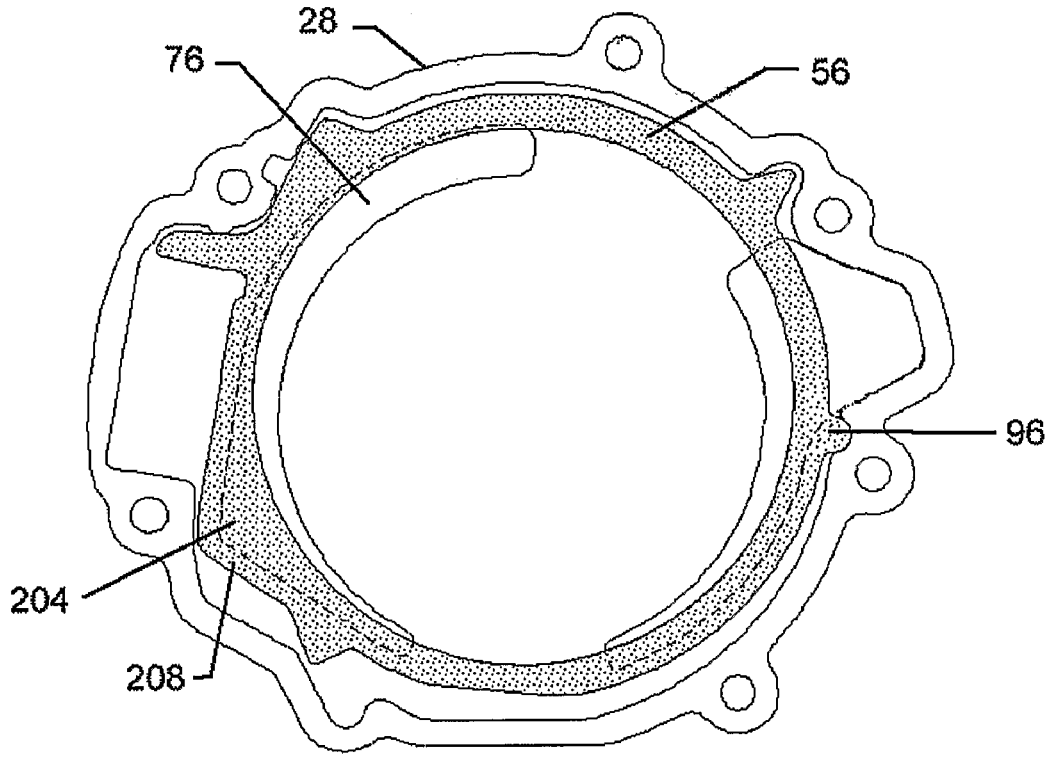
FIG. 12 shows the inlet port and outlet port of the rear plate, the body and cam ring of FIGS. 9 and 11 with the cam ring in the position of maximum eccentricity.
Figure 13:
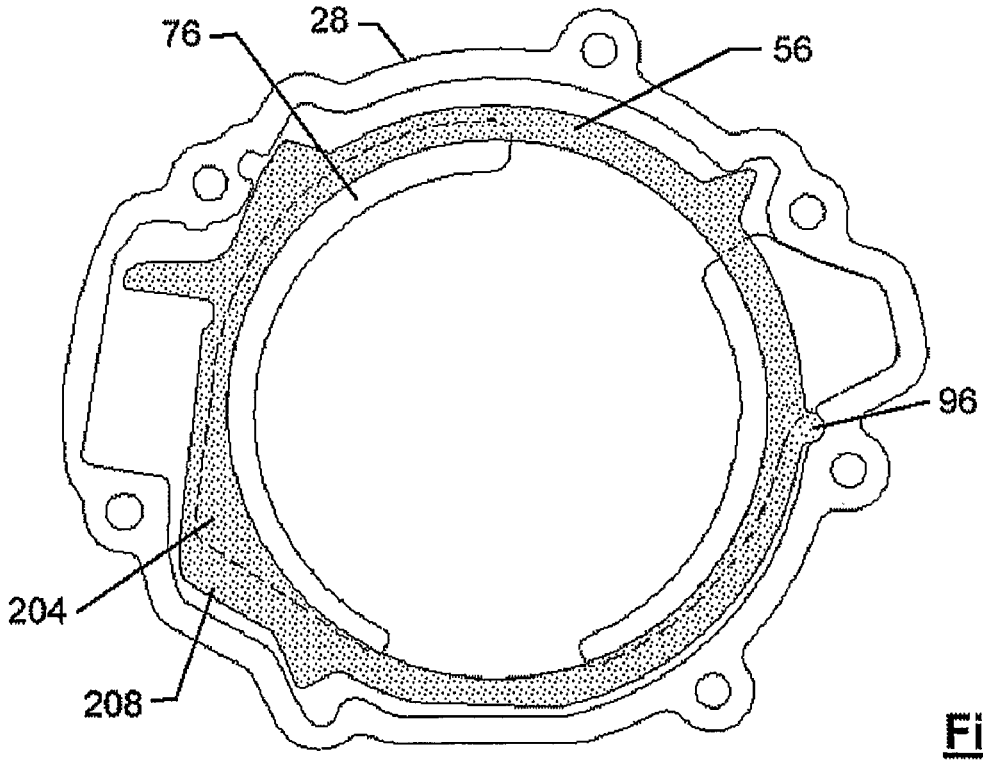
FIG. 13 shows the inlet port and outlet port of the rear plate, the body and cam ring of FIGS. 9 and 11 with the cam ring in the position of minimum eccentricity

To provide the necessary sealing between rear plate 32 and cam ring 56 about initial cross-sectional flow area 204, cam ring 56 (as shown in FIG. 11) includes a widened portion 208 which overlies cross-sectional flow area 204. FIG. 12 shows cam ring 56 within body 28 in a position of maximum eccentricity and FIG. 13 shows cam ring 56 within body 28 in a position of minimum eccentricity. As illustrated, widened portion 208 provides sufficient contact area between cam ring 56 and body 28 about area 204 to create an acceptable seal therebetween.

While pump 20 described above includes both the inventive orifice and two regulation chambers and the inventive inlet port with increased initial cross-sectional flow area, and while this combination is presently preferred, it will be apparent to those of skill in the art that either of these inventive features can be combined with conventional vane pumps to obtain many of the advantages discussed herein and such use of either inventive concept is contemplated by the present inventors.

The present invention provides a variable displacement vane pump with at least two regulation chambers to provide a regulating force to the cam ring, to counter the force applied to the cam ring by a regulating spring, to reduce pulsations in the output working fluid from the pump. A first one of the chambers is part of the outlet of the pump and is in fluid communication with the outlet port of the pump via a passage, preferably in the form of a groove-like feature which allows the pump to be fabricated from a diecast process or the like. A second regulation chamber is connected to the first chamber via an orifice which reduces the impact of pressure pulsations in the working fluid supplied from the first chamber to the second. The configuration and design of pumps in accordance with the present invention allows for flexible packaging for the pump, as the outlet need not overlie the pump outlet port. Further, the present invention provides a pump with an inlet port with a relatively large initial cross-sectional flow area to inhibit cavitation of the working fluid when the pump is operated at higher operating speeds.

The above-described embodiments of the invention are intended to be examples of the present invention and alterations and modifications may be effected thereto, by those of skill in the art, without departing from the scope of the invention which is defined solely by the claims appended hereto.

We claim:

1. A variable displacement vane pump comprising:

a rotor including a plurality of vanes slidably extending radially from the rotor;

a pump housing defining a pump inlet, a pump outlet and a rotor chamber receiving the rotor and including an inlet port in communication with the pump inlet and through which working fluid is introduced to the rotor and an outlet port through which working fluid exits the rotor to the pump outlet, the outlet port being connected to the pump outlet via a passage;

a cam ring encircling the rotor, the ends of the vanes of the rotor engaging the inner surface of the cam ring to form variable volume pump chambers between adjacent vanes, the rotor and the cam ring, the cam ring being pivotable within the rotor chamber about a pivot point to alter the eccentricity of the cam ring with respect to the rotor to change the displacement of the pump;

a regulating spring acting between the pump housing and the cam ring to bias the cam ring to a position of maximum eccentricity between the cam ring and the rotor;

a first regulating chamber receiving working fluid from the pump outlet, the working fluid applying a regulating force to the cam ring to counter the bias of the regulating spring; and a second regulating chamber receiving working fluid from the first regulating chamber via an orifice, the working fluid applying a regulating force to the cam ring to counter the bias of the regulating spring and the orifice altering the pressure of the working fluid received in the second regulating chamber with respect to the pressure of the regulating fluid in the first regulating chamber, wherein the first and second regulating chambers are separated by the orifice, the orifice being formed between the cam ring and the pump housing and maintaining a substantially constant cross-sectional flow area when the cam ring moves about the pivot point.

2. The variable displacement vane pump of claim 1 wherein the pump housing is formed by diecasting.

3. The variable displacement vane pump of claim 1 wherein the force applied by the working fluid in the second regulating chamber has a greater moment arm about the pivot point than the force applied by the working fluid in the first regulating chamber.

4. The variable displacement vane pump of claim 1 wherein the orifice is formed between a projection on the pump housing and a projection on the cam ring.

5. The variable displacement vane pump of claim 1 wherein the orifice is formed between a projection on the pump housing and a complementary recess on the cam ring.

6. The variable displacement vane pump of claim 1 wherein the orifice is formed between a projection on the cam ring and a complementary recess on the pump housing.

7. The variable displacement vane pump of claim 1 wherein the pivot point comprises a boss extending from one of the pump housing and the cam ring to engage a complementary groove on the other of the pump housing and cam ring.

8. The variable displacement vane pump of claim 7 wherein the boss is formed on the cam ring and the complementary groove is formed in the pump housing.

9. The variable capacity pump of claim 1 wherein the inlet port has a large initial cross-sectional flow area and the cam ring includes a widened portion to provide adequate sealing surfaces between the pump housing and the cam ring about the large initial cross-sectional flow area.

10. A variable displacement vane pump comprising:

a rotor including a plurality of vanes slidably extending radially from the rotor;

a pump housing defining a pump inlet, a pump outlet and a rotor chamber receiving the rotor and including an inlet port in communication with the pump inlet and through which working fluid is introduced to the rotor and an outlet port through which working fluid exits the rotor to the pump outlet, the outlet port being connected to the pump outlet via a passage;

a cam ring encircling the rotor, the ends of the vanes of the rotor engaging the inner surface of the cam ring to form variable volume pump chambers between adjacent vanes, the rotor and the cam ring, the cam ring being pivotable within the rotor chamber about a pivot point to alter the eccentricity of the cam ring with respect to the rotor to change the displacement of the pump;

a regulating spring acting between the pump housing and the cam ring to bias the cam ring to a position of maximum eccentricity between the cam ring and the rotor;

a first regulating chamber receiving working fluid from the pump outlet, the working fluid applying a regulating force to the cam ring to counter the bias of the regulating spring; and a second regulating chamber receiving working fluid from the first regulating chamber via an orifice, the working fluid applying a regulating force to the cam ring to counter the bias of the regulating spring and the orifice altering the pressure of the working fluid received in the second regulating chamber with respect to the pressure of the regulating fluid in the first regulating chamber, wherein the first and second regulating chambers are separated by the orifice, the orifice being formed between the cam ring and the pump housing, and further wherein the cross-sectional flow area of the orifice decreases as the cam ring moves from the position of maximum eccentricity.

11. The variable displacement vane pump of claim 10 wherein the pump housing is formed by diecasting.

12. The variable displacement vane pump of claim 10 wherein the force applied by the working fluid in the second regulating chamber has a greater moment arm about the pivot point than the force applied by the working fluid in the first regulating chamber.

13. The variable displacement vane pump of claim 10 wherein the orifice is formed between a projection on the pump housing and a projection on the cam ring.

14. The variable displacement vane pump of claim 10 wherein the orifice is formed between a projection on the pump housing and a complementary recess on the cam ring.

15. The variable displacement vane pump of claim 10 wherein the orifice is formed between a projection on the cam ring and a complementary recess on the pump housing.

16. A variable displacement vane pump comprising:

a rotor including a plurality of vanes slidably extending radially from the rotor;

a pump housing defining a pump inlet, a pump outlet and a rotor chamber receiving the rotor and including an inlet port in communication with the pump inlet and through which working fluid is introduced to the rotor and an outlet port through which working fluid exits the rotor to the pump outlet, the outlet port being connected to the pump outlet via a passage;

a cam ring encircling the rotor, the ends of the vanes of the rotor engaging the inner surface of the cam ring to form variable volume pump chambers between adjacent vanes, the rotor and the cam ring, the cam ring being pivotable within the rotor chamber about a pivot point to alter the eccentricity of the cam ring with respect to the rotor to change the displacement of the pump;

a regulating spring acting between the pump housing and the cam ring to bias the cam ring to a position of maximum eccentricity between the cam ring and the rotor;

a first regulating chamber receiving working fluid from the pump outlet, the working fluid applying a regulating force to the cam ring to counter the bias of the regulating spring; and a second regulating chamber receiving working fluid from the first regulating chamber via an orifice, the working fluid applying a regulating force to the cam ring to counter the bias of the regulating spring and the orifice altering the pressure of the working fluid received in the second regulating chamber with respect to the pressure of the regulating fluid in the first regulating chamber, wherein the first and second regulating chambers are separated by a sealing member and wherein the orifice is in the form of a passage about the sealing member.

17. The variable displacement vane pump of claim 16 wherein the force applied by the working fluid in the second regulating chamber has a greater moment arm about the pivot point than the force applied by the working fluid in the first regulating chamber.

18. The variable displacement vane pump of claim 16 wherein the orifice is formed between a projection on the cam ring and a complementary recess on the pump housing.

19. The variable capacity pump of claim 16 wherein the inlet port has a large initial cross-sectional flow area and the cam ring includes a widened portion to provide adequate sealing surfaces between the pump housing and the cam ring about the large initial cross-sectional flow area.

20. A variable capacity vane pump, comprising:

a rotor including a plurality of vanes extending substantially radially from the rotor;

a cam ring encircling the rotor, the vanes of the rotor engaging the inner surface of the cam ring to form pump chambers between the rotor, the cam ring and adjacent vanes, and the volume of the pump chambers changing as the rotor is rotated;

a pump housing including:

a rotor chamber receiving the rotor and cam ring, the cam ring being pivotable about a pivot point to alter the eccentricity of the cam ring with respect to the rotor to alter the amount by which the volume of the pump chambers changes as the rotor rotates;

a pump inlet to supply working fluid to the pump;

a pump outlet to supply working fluid from the pump;

an inlet port in fluid communication with the pump inlet to supply working fluid to the rotor;

an outlet port to receive working fluid from the rotor;

a passage connecting the outlet port to the pump outlet to transfer working fluid therebetween;

a first regulating chamber in fluid communication with the pump outlet to receive working fluid therefrom, the received working fluid creating a regulating force to urge the cam ring away from the position of maximum eccentricity;

a second regulating chamber connected to the first regulating chamber via an orifice, the second regulating chamber receiving working fluid from the first regulating chamber and the orifice altering the pressure of the received working fluid, received working fluid creating a regulating force to urge the cam ring away from the position of maximum eccentricity, wherein the orifice presents a substantially constant cross-sectional flow area to the working fluid independent of the position of the cam ring; and a regulating member acting between the pump housing and the cam ring to urge the cam ring to the position of maximum eccentricity.

21. The variable capacity vane pump of claim 20 wherein the regulating member is a spring.

22. The variable capacity vane pump of claim 20 wherein the pivot point comprises a boss extending from one of the housing and the cam ring to engage a complementary groove on the other of the housing and cam ring.

23. The variable capacity vane pump of claim 22 wherein the boss is formed on the cam ring and the complementary groove is formed in the housing.

24. The variable capacity pump of claim 20 wherein the inlet port has a large initial cross-sectional flow area and the cam ring includes a widened portion to provide adequate sealing surfaces between the pump housing and the cam ring about the large initial cross-sectional flow area.

25. A variable capacity vane pump, comprising:

a rotor including a plurality of vanes extending substantially radially from the rotor;

a cam ring encircling the rotor, the vanes of the rotor engaging the inner surface of the cam ring to form pump chambers between the rotor, the cam ring and adjacent vanes, and the volume of the pump chambers changing as the rotor is rotated;

a pump housing including:

a rotor chamber receiving the rotor and cam ring, the cam ring being pivotable about a pivot point to alter the eccentricity of the cam ring with respect to the rotor to alter the amount by which the volume of the pump chambers changes as the rotor rotates;

a pump inlet to supply working fluid to the pump;

a pump outlet to supply working fluid from the pump;

an inlet port in fluid communication with the pump inlet to supply working fluid to the rotor;

an outlet port to receive working fluid from the rotor;

a passage connecting the outlet port to the pump outlet to transfer working fluid therebetween;

a first regulating chamber in fluid communication with the pump outlet to receive working fluid therefrom, the received working fluid creating a regulating force to urge the cam ring away from the position of maximum eccentricity;

a second regulating chamber connected to the first regulating chamber via an orifice, the second regulating chamber receiving working fluid from the first regulating chamber and the orifice altering the pressure of the received working fluid, received working fluid creating a regulating force to urge the cam ring away from the position of maximum eccentricity, wherein the orifice presents a decreasing cross-sectional flow area to the working fluid as the cam ring moves from the position of maximum eccentricity; and a regulating member acting between the pump housing and the cam ring to urge the cam ring to the position of maximum eccentricity.

26. The variable capacity vane pump of claim 25 wherein the pivot point comprises a boss extending from one of the housing and the cam ring to engage a complementary groove on the other of the housing and cam ring.

27. The variable capacity vane pump of claim 26 wherein the boss is formed on the cam ring and the complementary groove is formed in the housing.

28. The variable capacity pump of claim 25 wherein the inlet port has a large initial cross-sectional flow area and the cam ring includes a widened portion to provide adequate sealing surfaces between the pump housing and the cam ring about the large initial cross-sectional flow area.

* * * * *